US007796908B2

(12) United States Patent
Hasegawa

(10) Patent No.: US 7,796,908 B2
(45) Date of Patent: Sep. 14, 2010

(54) IMAGE FORMING APPARATUS AND CONTROL METHOD THEREOF

(75) Inventor: Satoshi Hasegawa, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 816 days.

(21) Appl. No.: 11/668,573

(22) Filed: Jan. 30, 2007

(65) Prior Publication Data

US 2008/0181640 A1 Jul. 31, 2008

(51) Int. Cl.
*G03G 15/20* (2006.01)
*G03G 15/00* (2006.01)

(52) U.S. Cl. ..... 399/69; 399/70; 399/88

(58) Field of Classification Search ..... 399/70, 399/88, 69

See application file for complete search history.

(56) References Cited

U.S. PATENT DOCUMENTS

2005/0169659 A1* 8/2005 Koyama et al. ..... 399/88
2006/0051121 A1* 3/2006 Matsusaka et al. ..... 399/70

FOREIGN PATENT DOCUMENTS

JP 2004-253349 9/2004
JP 2004-310055 11/2004

* cited by examiner

*Primary Examiner*—David P Porta
*Assistant Examiner*—Bryan P Ready
(74) *Attorney, Agent, or Firm*—Turocy & Watson, LLP

(57) ABSTRACT

An image forming apparatus includes a fixing device including a heater to which electric power is fed from a commercial power supply and a temperature sensor that detects the temperature of the heater, an auxiliary power supply that is charged by the commercial power supply and discharges electricity to a specific load, and a control unit that controls ON and OFF of the heater and ON and OFF of charging of the auxiliary power supply. The control unit turns on the heater when a detected temperature of the sensor is lower than a first set temperature and turns off when the detected temperature is higher than the first set temperature, while the control unit turns on the charging of the auxiliary power supply when the detected temperature is higher than a second set temperature higher than the first set temperature and turns off the charging when the detected temperature is lower than the second set temperature.

18 Claims, 6 Drawing Sheets

IMAGE FORMING APPARATUS AND CONTROL METHOD THEREOF

BACKGROUND OF THE INVENTION

1. Field of the Invention

The present invention relates to an image forming apparatus and a control method thereof, and, more particularly to an image forming apparatus employing an electrophotographic system and a control method thereof.

2. Description of the Related Art

In an image forming apparatus such as a copying machine employing an electrophotographic system, a process for developing an electrostatic latent image formed on a photoconductive drum using a toner or the like, transferring a toner image developed onto a recording sheet, and then heating and pressing the toner image with a fixing device to fix the toner image on the recording sheet is adopted.

As a structure of the fixing device, a form of using a heating roller having a heater built therein is often adopted. The toner image on the recording sheet is fixed by directly applying heat of the heating roller to the recording sheet or indirectly applying the heat to the recording sheet via a fixing belt or the like.

In order to secure satisfactory fixing performance, it is important to maintain the temperature of the heating roller within a predetermined range.

However, the temperature of the heating roller is low during starting of the image forming apparatus and immediately after the image forming apparatus is returned from a standby mode. Thus, in order to heat the heating roller using the heater to set the temperature of the heating roller within the predetermined temperature range, warm-up for a predetermined time is necessary. In order to reduce this warm-up time, there is a form of using an auxiliary heater in addition to a normal heater (hereinafter referred to as main heater).

For example, in JP-A 2004-253349 and JP-A 2004-310055, there are disclosed techniques for using a commercial power supply as a power supply for a main heater and using an auxiliary power supply, for example, an electric double layer capacitor as a power supply for an auxiliary heater.

In these disclosed techniques, the auxiliary power supply for the auxiliary heater is charged using the commercial power supply when electric power of the commercial power supply is not fed to the main heater. This prevents power consumption of an entire image forming apparatus from exceeding a predetermined range.

In other words, power consumption equal to or larger than a specified value is prevented from occurring by preventing a period of power feeding to the main heater and a period of charging of the auxiliary power supply from overlapping each other.

However, when, for example, a power feeding control signal is used for determination on presence or absence of the power feeding to the main heater, ON and OFF of charging of the auxiliary power supply is controlled according to ON and OFF of the power feeding control signal. In this case, there is a delay time from the time when the power feeding control signal is turned on until electric power is actually supplied to the main heater. Similarly, there is a delay time from the time when the power feeding control signal is turned off until power supply to the main heater actually stops. Because of these delay times, it is likely that the period of power feeding to the main heater and the period of charging of the auxiliary power supply instantaneously overlap each other and power consumption equal to or larger than the specified value occurs.

There is also a method of, for example, detecting the temperature of a main heater with a sensor and determining presence or absence of power feeding to the main heater according to this detected temperature. In this case, a delay also occurs between timing of power feeding to the main heater and a change in the detected temperature of the main heater. For example, since temperature detected by the temperature sensor is low immediately after electric power is supplied to the main heater, it is likely that it is determined by mistake that electric power is not supplied to the main heater to permit charging of an auxiliary power supply. As a result, the power feeding to the main heater and the charging of the auxiliary power supply are simultaneously performed. Electric power equal to or larger than the specified value is temporarily consumed.

SUMMARY OF THE INVENTION

The invention has been devised in view of the above-mentioned circumstances and it is an object of the invention to provide an image forming apparatus including a main heater that uses a commercial power supply and a chargeable auxiliary power supply, the image forming apparatus being capable of surely separating a period of power feeding to the main heater and a period of charging of the auxiliary power supply and preventing power consumption from increasing to be equal to or higher than a specified value, and a control method thereof.

In order to attain the object, an image forming apparatus according to an aspect of the invention includes a fixing device including a heater to which electric power is fed from a commercial power supply and a temperature sensor that detects the temperature of the heater, an auxiliary power supply that is charged by the commercial power supply and discharges electricity to a specific load, and a control unit that controls ON and OFF of the heater and ON and OFF of charging of the auxiliary power supply. The control unit turns on the heater when a detected temperature of the temperature sensor is lower than a first set temperature and turns off the heater when the detected temperature is higher than the first set temperature. On the other hand, the control unit turns on the charging of the auxiliary power supply when the detected temperature is higher than a second set temperature higher than the first set temperature and turns off the charging of the auxiliary power supply when the detected temperature is lower than the second set temperature.

In order to attain the object, an image forming apparatus according to another aspect of the invention includes fixing means including heating means to which electric power is fed from a commercial power supply and temperature detecting means for detecting the temperature of the heating means, charging and discharging means for being charged by the commercial power supply and discharging electricity to a specific load, and controlling means for controlling ON and OFF of the heating means and ON and OFF of charging of the charging and discharging means. The controlling means turns on the heating means when a detected temperature of the temperature detecting means is lower than a first set temperature and turns off the heating means when the detected temperature is higher than the first set temperature. On the other hand, the controlling means turns on the charging of the charging and discharging means when the detected temperature is higher than a second set temperature higher than the first set temperature and turns off the charging of the charging and discharging means when the detected temperature is lower than the second set temperature.

In order to attain the object, a control method of an image forming apparatus according to still another aspect of the invention is a control method of an image forming apparatus that includes a fixing device including a heater to which electric power is fed from a commercial power supply and a temperature sensor that detects the temperature of the heater and an auxiliary power supply that is charged by the commercial power supply and discharges electricity to a specific load. The control method of an image forming apparatus includes turning on the heater when a detected temperature of the temperature sensor is lower than a first set temperature, turning off the heater when the detected temperature is higher than the first set temperature, turning on the charging of the auxiliary power supply when the detected temperature is higher than a second set temperature higher than the first set temperature, and turning off the charging of the auxiliary power supply when the detected temperature is lower than the second set temperature.

DETAILED DESCRIPTION OF THE INVENTION

Embodiments of an image forming apparatus and a control method thereof according to the invention will be explained with reference to the accompanying drawings.

(1) Structure of an Image Forming Apparatus

Figure 1:
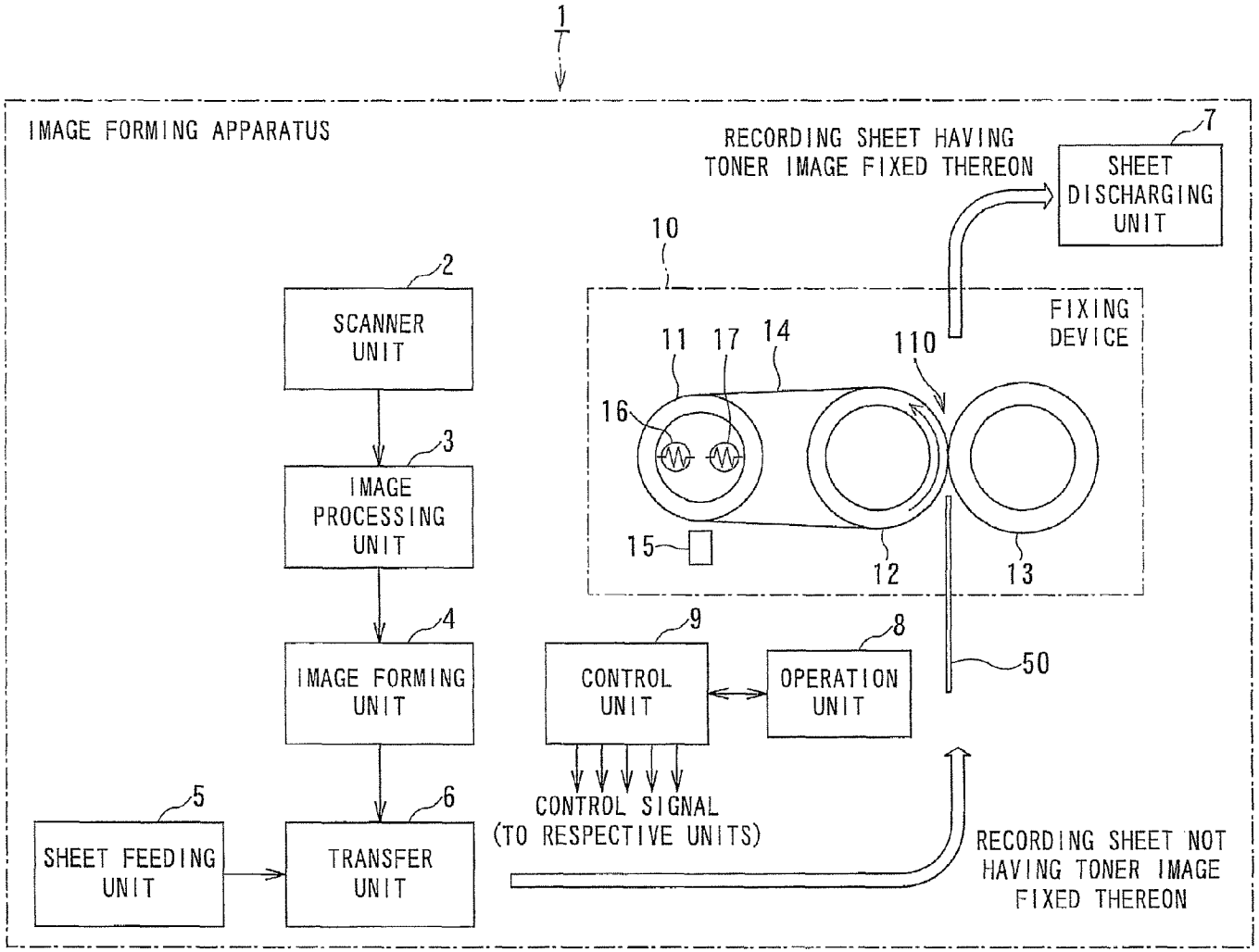
FIG. 1 is a diagram showing an example of an overall structure of an image forming apparatus according to a first embodiment of the invention.

FIG. 1 is a diagram showing an example of a structure of an image forming apparatus 1 according to a first embodiment of the invention.

The image forming apparatus 1 includes, for example, a scanner unit 2, an image processing unit 3, an image forming unit 4, a sheet feeding unit 5, a transfer unit 6, a sheet discharging unit 7, an operation unit 8, a control unit (controlling means) 9, and a fixing device (fixing means) 10.

The scanner unit 2 scans reflected light from an original with, for example, a CCD sensor and converts the reflected light into image data.

The image processing unit 3 applies various kinds of image processing such as color conversion processing, filtering processing, and gradation processing to the image data scanned.

The image forming unit 4 performs, for example, pulse width modulation according to intensity of the image data subjected to the image processing and forms an electrostatic latent image on a photoconductive drum using a laser beam or the like. Moreover, the image forming unit 4 develops the electrostatic latent image with a toner and forms a toner image on the photoconductive drum.

The transfer unit 6 transfers the toner image on the photoconductive drum onto a sheet conveyed from the sheet feeding unit 5. The transfer from the photoconductive drum onto the sheet may be directly performed or the toner image on the photoconductive drum may be intermediately transferred onto an intermediate transfer member once and transferred onto the sheet from the intermediate transfer member again.

A sheet (a sheet not having the toner image fixed thereon) 50 having the toner image transferred thereon is outputted from the transfer unit 6 to the fixing device 10. The sheet having the toner image fixed thereon by the fixing device 10 is outputted to the outside from the sheet discharging unit 7.

The operation unit 8 includes, for example, an operation panel including a liquid crystal display and a touch panel and appropriate keys.

The control unit 9 includes a processor and the like and performs control of the entire image forming apparatus 1. As described later, ON and OFF control of a main heater (heating means) 16 of the fixing device 10 and ON and OFF control of charging of an auxiliary power supply 20 are also performed by this control unit 9.

FIG. 1 is a diagram showing an example of a structure of the image forming apparatus 1 serving as a copying machine. However, it is also possible to cause the image forming apparatus 1 to function as a printer. In this case, image data created in an external apparatus such as a personal computer is inputted to the image processing unit 3 via an external interface (not shown).

A detail structure of the fixing device 10 will be explained.

The fixing device 10 includes a heating roller 11, a fixing roller 12, a pressure roller 13, and a fixing belt 14. A temperature sensor (temperature detecting means) 15 is disposed near the heating roller.

The fixing belt 14 is an endless belt wound around the heating roller 11 and the fixing roller 12 and turns between the heating roller 11 and the fixing roller 12.

The pressure roller 13 is set in press contact with the fixing roller 12 via the fixing belt 14. The sheet 50 not having a toner image fixed thereon conveyed from the transfer unit 6 is applied with heat and pressure while the sheet 50 passes through a contact portion (a nip portion 110) between the pressure roller 13 and the fixing belt 14 and the unfixed toner image is fixed on the sheet 50.

The fixing belt 14 is formed by using a thin seamless belt molded from metal such as nickel or heat resistant resin such as polyimide as a substrate and coating heat resistant rubber such as silicone rubber or fluororubber and fluorine resin impregnated with oil over the surface of the substrate or formed by coating heat resistant highly releasable resin such as PFA (PerFluoro alkoxyl Alkane) tube over silicone rubber.

In this embodiment, a heat resistant elastic layer of silicone rubber coated at the thickness of about 200 μm is provided on an outer peripheral surface of a thin seamless belt formed by nickel electrocasting with the thickness of about 37 μm and a tube with the thickness of about 30 μm is coated over the outer peripheral surface. On the inner side of this fixing belt 14, there are arranged the heating roller 11 that heats the fixing belt 14 and applies tension to this fixing belt 14 and the fixing roller 12 that drives the fixing belt 14 and forms a fixing area between the fixing roller 12 and the pressure roller 13.

The heating roller 11 according to this embodiment is formed by coating a coating layer of PTFE (Poly TetraFluoro Ethylene) with the thickness of about 20 μm over a core bar of an aluminum pipe with the diameter of about 30 mm and the thickness of about 1 mm.

A main heater 16 and an auxiliary heater 17 are provided in the inside of the heating roller 11 as heat generating sources. The main heater 16 is a shaft-like heater lamp that uses the commercial power supply as a power source. The auxiliary heater 17 is a shaft-like heater lamp that uses a chargeable auxiliary power supply (charging and discharging means), for example, an electric double layer capacitor as a power source.

In the form shown in FIG. 1, both the main heater 16 and the auxiliary heater 17 are built in the heating roller 11. However, the main heater 16 and the auxiliary heater 17 are not limited to this form.

Figure 2:
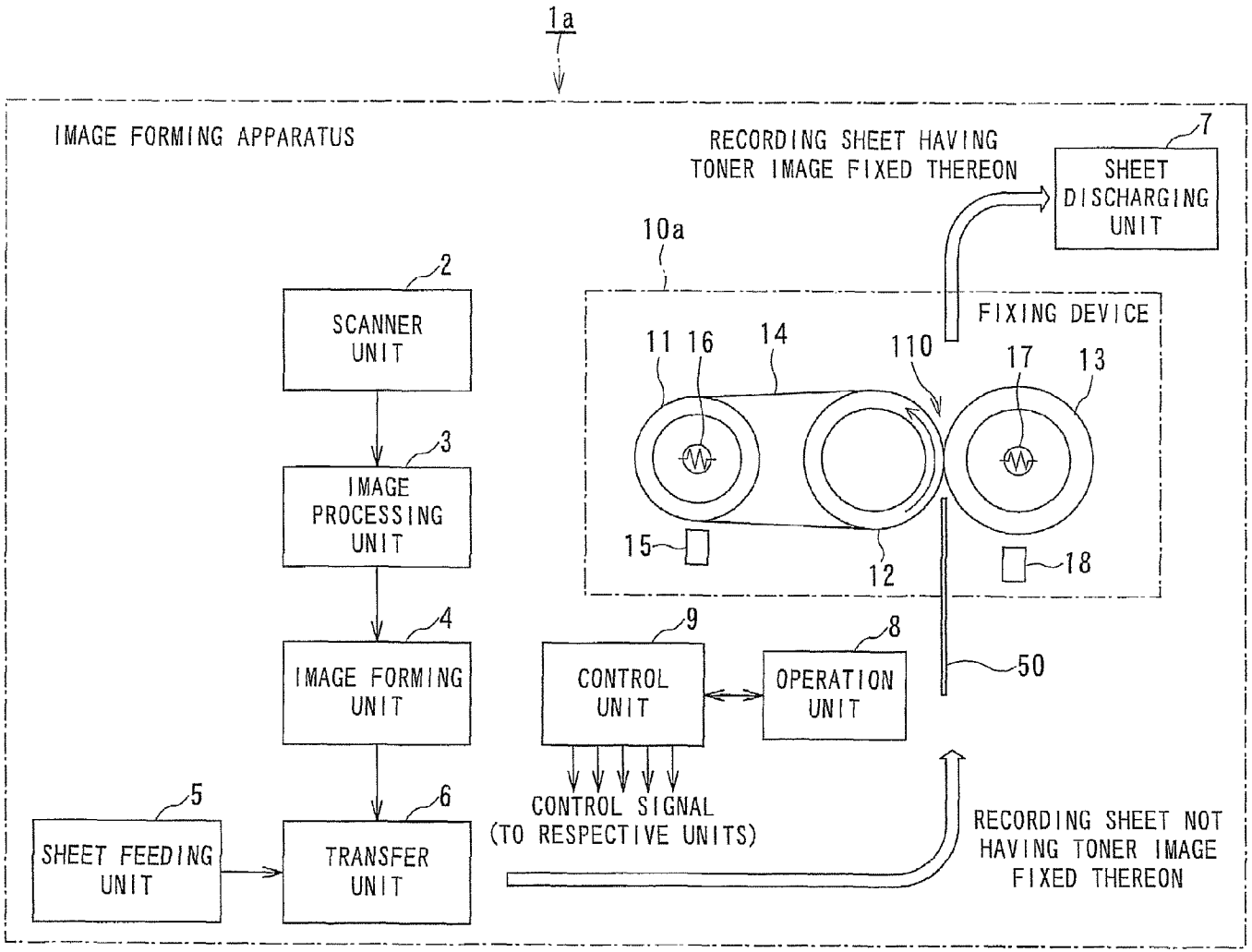
FIG. 2 is a diagram showing an example of an overall structure of an image forming apparatus according to a second embodiment of the invention.

For example, FIG. 2 is a diagram showing an example of a structure of an image forming apparatus 1*a* according to a second embodiment. In this form, the main heater 16 is built in the heating roller 11 and, on the other hand, the auxiliary heater 17 is built in the pressure roller (in this case, performing both pressing and heating) 13. In the second embodiment, in order to detect the temperature of the pressure roller 13, a temperature sensor 18 is provided near the pressure roller.

Figure 3:
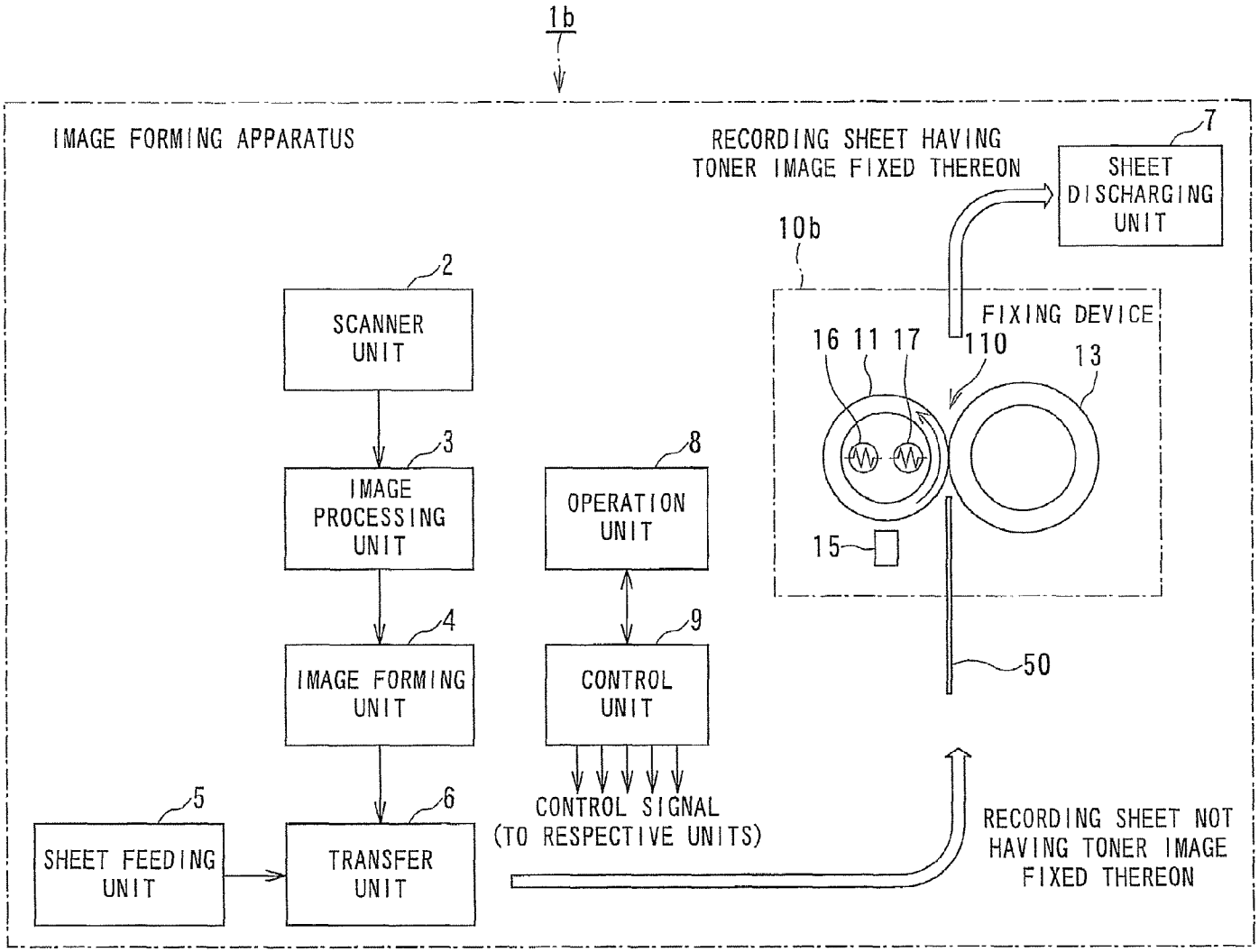
FIG. 3 is a diagram showing an example of an overall structure of an image forming apparatus according to a third embodiment of the invention.

Besides, as in an image forming apparatus 1*b* according to a third embodiment shown in FIG. 3, the heating roller 11 and the pressure roller 13 are directly in contact with each other without the intervention of the fixing belt 14 to form the nip portion 110. In this case, as in the above case, both the main heater 16 and the auxiliary heater 17 may be built in the heating roller 11 as shown in FIG. 3. Alternatively, although not shown in the figure, it is also possible that the main heater 16 is built in the heating roller 11 and the auxiliary heater 17 is built in the pressure roller 13.

The point of this embodiment resides in a method of ON and OFF control of electric power (electric power of a commercial power supply) supplied to the main heater 16 and ON and OFF control of charging of an auxiliary power supply supplied to loads such as the auxiliary heater 17. This control method will be hereinafter explained.

(2) Control Method of an Image Forming Apparatus

Figure 4:
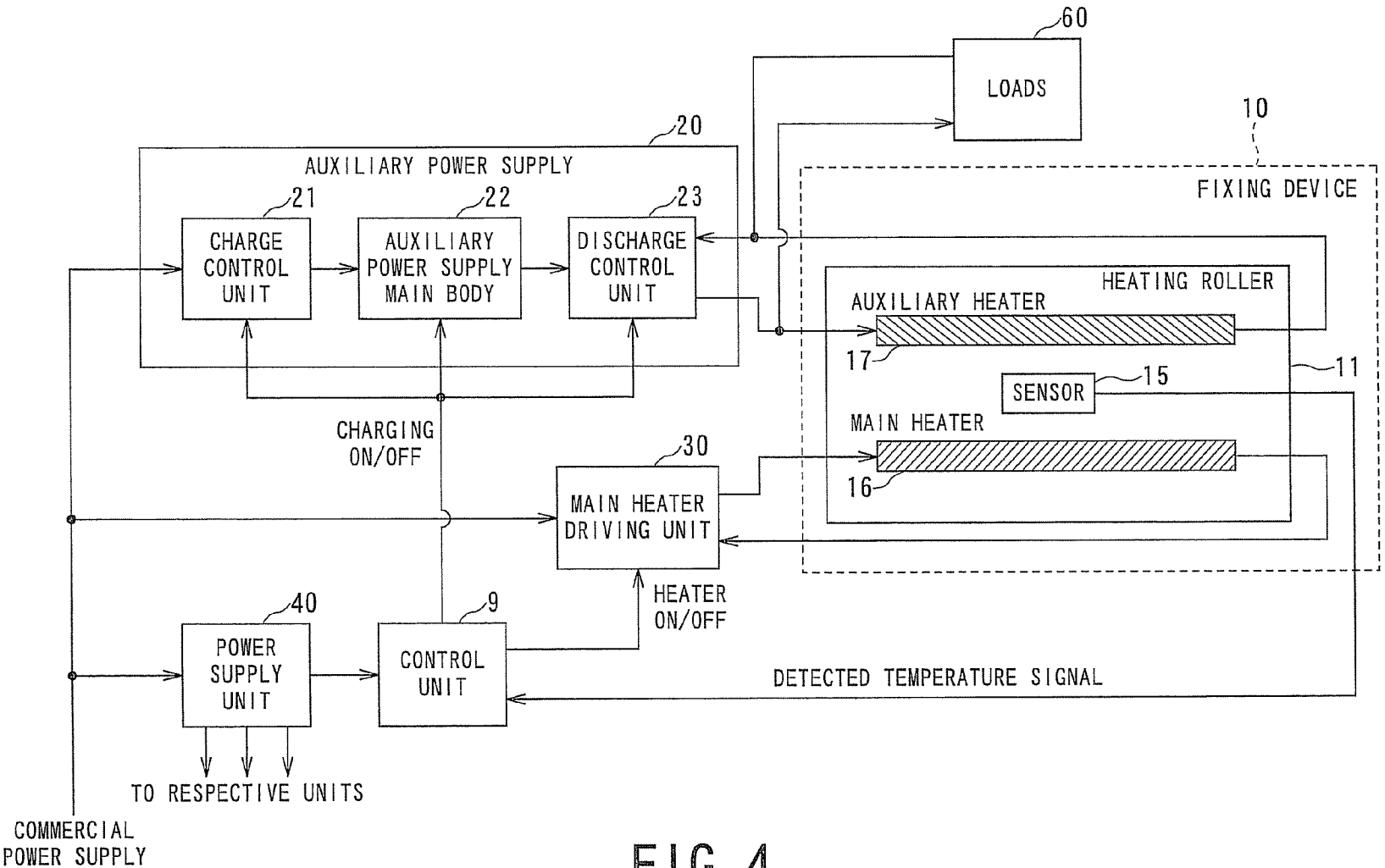
FIG. 4 is a diagram showing an example of a detail structure related to control of a main heater and related to an auxiliary power supply that supplies electric power to an auxiliary heater and other loads.

FIG. 4 is a diagram showing an example of a detail structure related to control of the main heater 16 and related to the auxiliary power supply 20 that supplies electric power to the auxiliary heater 17 and other loads 60.

The main heater 16 is driven by electric power of the commercial power supply via a main heater driving unit 30. The main heater driving unit 30 drives the main heater 16 by turning on and off the commercial power supply. Besides, the main heater driving unit 30 may drive the main heater 16 by changing electric power supplied to the main heater 16. The control unit 9 performs ON and OFF control for the main heater driving unit 30 on the basis of an operation state of the image forming apparatus 1 at the time of the control and a detected temperature of the temperature sensor 15.

On the other hand, the auxiliary heater 17 and the loads 60 are driven by electric power supplied from the auxiliary power supply 20. The auxiliary power supply 20 includes, for example, an auxiliary power supply main body 22 constituted by an electric double layer capacitor or a large capacity battery, a charge control unit 21 that performs charging control for the auxiliary power supply main body 22, and a discharge control unit 23 that performs control of discharge from the auxiliary power supply main body 22.

When supply of electric power from the auxiliary power supply 20 to the auxiliary heater 17 and the loads 60 continues for a certain time, it is necessary to charge the auxiliary power supply 20 using the commercial power supply.

Usually, in the image forming apparatus 1, maximum power consumption of the commercial power supply in use is set to be equal to or smaller than specified electric power. This is because allowable maximum electric power of a general wall outlet for home use and allowable maximum electric power of a power cable connected to this wall outlet are set to certain specified electric power.

Specifically, in the case of Japan, this specified electric power is set as 1500 W (100 V, 15 A). In the case of the United States, in general, the specified electric power is set as 1500 W (115 V, 12 A).

When it is attempted to consume electric power exceeding this specified electric power in the image forming apparatus 1, for example, it is necessary to connect two power cables to two wall outlets. This is inconvenient in terms of handling.

There is also a method of extracting large electric power by setting a voltage of the commercial power supply to a higher voltage, for example, 200 V. However, since wiring work is required additionally, this method is also inconvenient.

Therefore, many image forming apparatuses 1 are designed such that maximum power consumption of the commercial power supply does not exceed the specified electric power.

On the other hand, in the image forming apparatus 1 employing the electrophotographic system, it is necessary to maintain the fixing device 10 in a predetermined temperature range in order to secure stable fixing performance. Heating of the fixing device 10 is extremely important. Further, during starting and the like of the image forming apparatus 1, since the temperature of the fixing device 10 and peripherals is low, warming-up is necessary. However, large electric power is required to reduce time for this warm-up.

Therefore, when the main heater 16 is on, electric power of the commercial power supply consumed by the main heater 16 and the other components is supplied at maximum electric power substantially close to the specified electric power. Moreover, a shortage of electric power is often covered by discharging electric power of the auxiliary power supply 20.

As a result, when the main heater 16 is on, if the auxiliary power supply 20 is charged, it is likely that consumption of the commercial power supply further increases and exceeds the specified electric power.

On the other hand, the main heater 16 is intermittently (irregularly) subjected to ON and OFF control on the basis of information of the temperature sensor provided in the fixing device 10 in order to maintain the fixing device 10 within a set temperature range.

The point of this embodiment resides in a point that, even when the main heater 16 is irregularly turned on and off in this way, an ON period of the main heater 16 and a charging ON period of the auxiliary power supply 20 are surely separated to prevent the periods from overlapping each other. This control is performed by the control unit 9.

Figure 5:
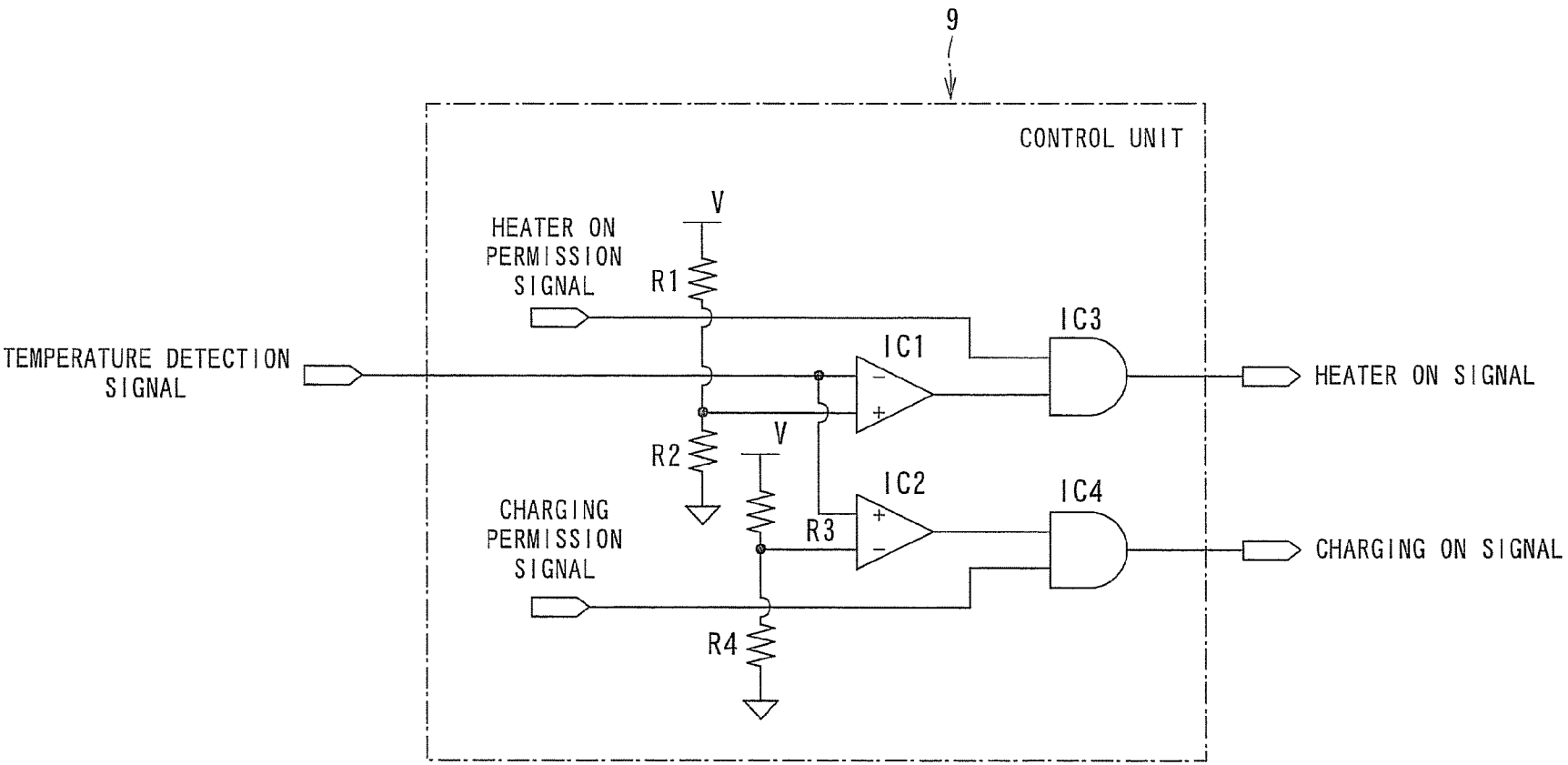
FIG. 5 is a diagram showing an example of a circuit for realizing control for separating an ON period of the main heater and a charging ON period of an auxiliary power supply.

FIG. 5 is a diagram showing an example of a circuit of the control unit 9 that realizes the control described above. This circuit includes four resistors R1, R2, R3, and R4, two comparators IC1 and IC2, and two AND circuits IC3 and IC4.

A detected temperature of the fixing device 10 is converted into a voltage value by the temperature sensor 15 provided in the fixing device 10 and inputted to "– input terminals" of the comparators IC1 and "+ input terminals" of the comparators IC2 as a detected temperature signal. A voltage of this detected temperature signal is a voltage corresponding to the detected temperature.

On the other hand, a first reference voltage obtained by dividing a fixed voltage V with the resistors R1 and R2 is inputted to a "+ input terminal" of the comparator IC1. This first reference voltage is a voltage corresponding to a first set temperature for turning on the main heater. An output of the comparator IC1 is "H" when a detected temperature is lower than the first set temperature and is "L" when the detected temperature is higher than the first set temperature.

The output of the comparator IC1 is AND-operated with a "heater ON permission signal" in an AND circuit IC3 at the next stage to be changed to a "heater ON signal".

The "heater ON permission signal" is a signal that is set to "H" when it is desired to keep the main heater 16 in a certain temperature range during printing, standby, and the like and is set to "L" when it is desired to turn off the main heater 16 during a sleep mode, occurrence of an error, and the like. The "heater ON signal" is a signal for turning on the main heater 16 when the signal is "H" and turning off the main heater 16 when the signal is "L".

As a result, the main heater 16 is controlled to be turned on when the "heater ON permission signal" is set to "H" and a detected temperature is lower than the first set temperature. Further, the main heater 16 is controlled to be turned off when the "heater ON permission signal" is set to "L" or the detected temperature is higher than the first set temperature.

On the other hand, a second reference voltage obtained by dividing the fixed voltage V with the resistors R3 and R4 is inputted to a "– input terminal" of the comparator IC2. This second reference voltage is a voltage corresponding to a second set temperature for turning on charging of the auxiliary power supply 20. It is important that this second set temperature is set to temperature higher than the first set temperature. An output of the comparator IC 2 is "H" when a detected temperature is higher than the second set temperature and is "L" when the detected temperature is lower than the second set temperature.

The output of the comparator IC2 is AND-operated with a "charge permission signal" by the AND circuit IC4 at the next stage to be changed to a "charge ON signal".

The "charge permission signal" is a signal that is set to "L" when charging is unnecessary, for example, during full charge of the auxiliary power supply 20, and is set to "H" only when charging is necessary. The "charge ON signal" is a signal for charging (charging on) the auxiliary power supply 20 when the signal is "H" and prohibiting charging of (charging off) the auxiliary power supply 20 when the signal is "L".

As a result, the auxiliary power supply 20 is controlled to be charged when the "charge permission signal" is set to "H" and a detected temperature is higher than the second set temperature. Further, the auxiliary power supply 20 is controlled to be prohibited from being charged when the "charge permission signal" is set to "L" or a detected temperature is lower than the second set temperature.

Figure 6:
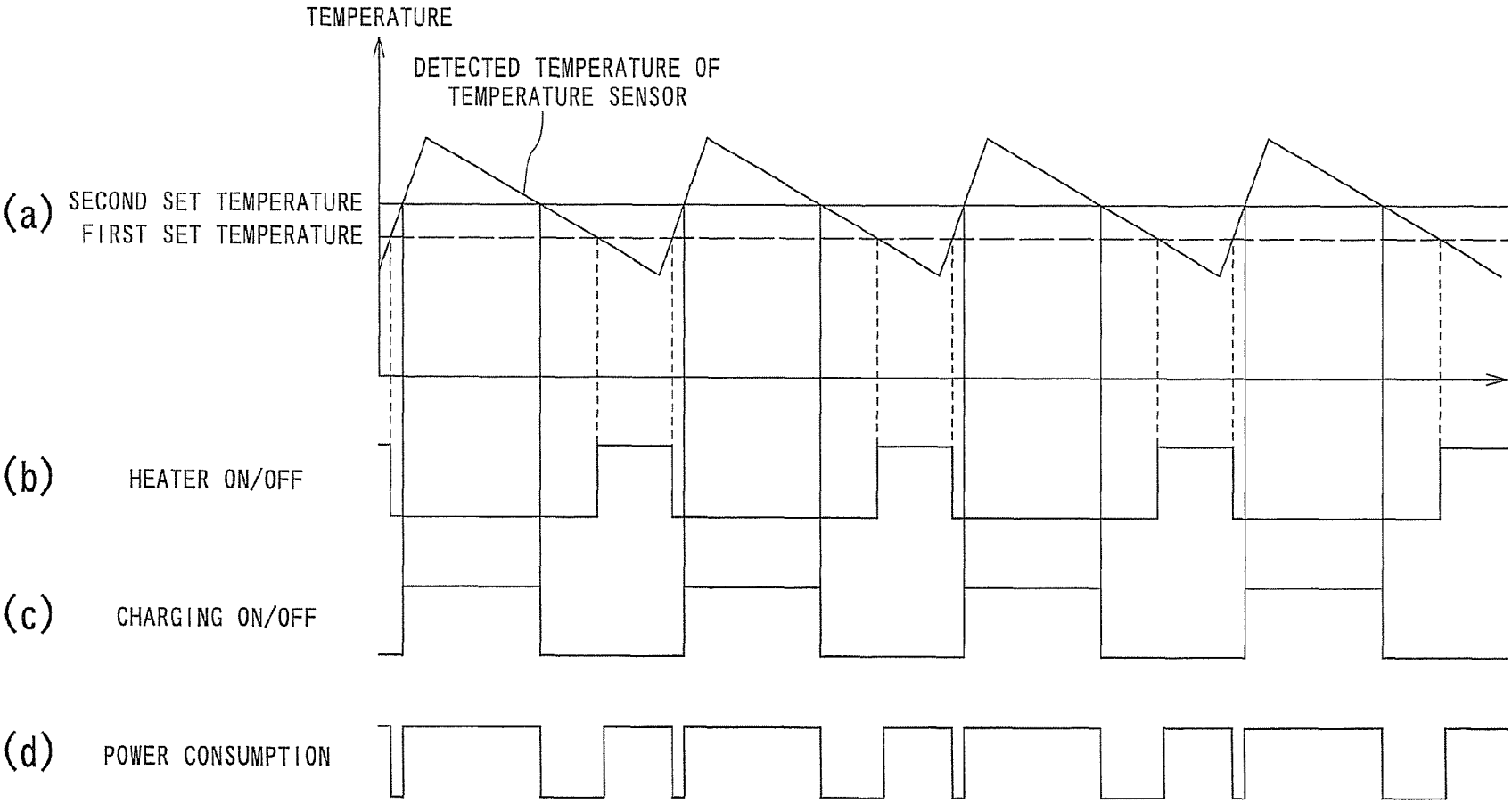
FIG. 6 is a timing chart mainly showing operation timing of a main heater and an auxiliary power supply according to an embodiment of the invention.

FIG. 6 is a diagram showing an example of an operation timing chart at the time when the control circuit shown in FIG. 5 is used. In the figure, both the "heater ON permission signal" and the "charge permission signal" are set to "H".

As shown in FIGS. 6(*a*) and 6(*b*), the main heater 16 is turned on when a detected temperature of the temperature sensor is lower than the first set temperature and is turned off when the detected temperature of the temperature sensor is higher than the first set temperature. In this case, actual driving and stop of the main heater 16 have a delay with respect to the "heater ON signal" and temperature detection in the temperature sensor 15 is delayed from an actual temperature. Thus, when a detected temperature changes from temperature higher than the first set temperature to temperature lower than the first set temperature, the detected temperature starts to rise at low temperature compared with the first set temperature. Conversely, when a detected temperature changes from temperature lower than the first set temperature to temperature higher than the first set temperature, the detected temperature starts to fall at high temperature compared with the first set temperature. Since the fixing device 10 is heated by the main heater 16 during the temperature rise and the temperature of the fixing device 10 falls because of natural heat radiation during the temperature fall. Thus, an inclination during the temperature rise is steeper than an inclination during the temperature fall. Therefore, actually, a detected temperature transitions at temperature higher than the first set temperature. In particular, when the fixing roller is not driven during standby and the like, this phenomenon appears markedly because the temperature of the fixing device 10 falls solely because of the natural heat radiation.

On the other hand, charging of the auxiliary power supply 20 is turned on in accordance with the "charge ON signal" when a detected temperature is higher than the second set temperature and is prohibited (turned off) when a detected temperature is lower than the second set temperature.

In this case, as described above, the second set temperature is set to a value larger than the first set temperature. Therefore, as shown in FIGS. 6(*b*) and 6(*c*), a period in which the main heater 16 is turned on and a period in which charging of the auxiliary power supply 20 is turned on do not overlap each other.

As a result, as shown in FIG. 6(*d*), power consumption of the commercial power supply always transitions within a range of the specified electric power and does not exceed the specified power supply.

As explained above, according to the image forming apparatus 1 and the control method thereof according to this embodiment, even when a charging operation for the auxiliary power supply 20 is performed while the fixing device 10 is heated, it is possible to surely separate a power feeding period for the main heater 16 and a charging period for the auxiliary power supply 20 and prevent power consumption of the commercial power supply from increasing to be equal to or larger than the specified value.

The invention is not limited to the embodiments described above per se. At an implementation stage, it is possible to modify and embody the elements without departing from the spirit of the invention. It is possible to form various embodiments of the invention according to appropriate combinations of the plural elements disclosed in the embodiments. For example, several elements may be deleted from all the elements described in the embodiments. Moreover, the elements described in the different embodiments may be combined as appropriate.

What is claimed is:

1. An image forming apparatus comprising:

a fixing device including a heater to which electric power is fed from a commercial power supply and a temperature sensor that detects temperature of the heater;

an auxiliary power supply that is charged by the commercial power supply and discharges electricity to a specific load; and a control unit configured to control ON and OFF of the heater and ON and OFF of charging of the auxiliary power supply, wherein the control unit turns on the heater when a detected temperature of the temperature sensor descends and it becomes lower than a first set temperature and turns off the heater when the detected temperature rises and it becomes higher than the first set temperature, and, on the other hand, the control unit turns on the charging of the auxiliary power supply when the detected temperature rises and it becomes higher than a second set temperature, the second set temperature being higher than the first set temperature, and turns off the charging of the auxiliary power supply when the detected temperature descends and it becomes lower than the second set temperature.

2. An image forming apparatus according to claim 1, wherein the control unit turns on the heater only when heating of the fixing device is permitted.

3. An image forming apparatus according to claim 1, wherein the control unit turns on the charging of the auxiliary power supply only when the charging of the auxiliary power supply is permitted.

4. An image forming apparatus according to claim 1, wherein the control unit compares a voltage of the detected temperature signal outputted from the temperature sensor and a first reference voltage corresponding to the first set temperature to generate a control signal for turning on or off the heater, and the control unit compares the voltage of the detected temperature signal and a second reference voltage corresponding to the second set temperature to generate a control signal for turning on or off the charging of the auxiliary power supply.

5. An image forming apparatus according to claim 1, wherein the specific load of the auxiliary power supply is a load including an auxiliary heater further included in the fixing device.

6. An image forming apparatus according to claim 1, wherein the auxiliary power supply is an auxiliary power supply including an electric double layer capacitor.

7. An image forming apparatus comprising:

fixing means including heating means to which electric power is fed from a commercial power supply and temperature detecting means for detecting temperature of the heating means;

charging and discharging means for being charged by the commercial power supply and discharging electricity to a specific load; and controlling means for controlling ON and OFF of the heating means and ON and OFF of charging of the charging and discharging means, wherein the controlling means turns on the heating means when a detected temperature of the temperature detecting means descends and it becomes lower than a first set temperature and turns off the heating means when the detected temperature rises and it becomes higher than the first set temperature, and, on the other hand, the controlling means turns on the charging of the charging and discharging means when the detected temperature rises and it becomes higher than a second set temperature, the second set temperature being higher than the first set temperature, and turns off the charging of the charging and discharging means when the detected temperature descends and it becomes lower than the second set temperature.

8. An image forming apparatus according to claim 7, wherein the controlling means turns on the heating means only when heating of the fixing means is permitted.

9. An image forming apparatus according to claim 7, wherein the controlling means turns on the charging of the charging and discharging means only when the charging of the charging and discharging means is permitted.

10. An image forming apparatus according to claim 7, wherein the controlling means compares a voltage of the detected temperature signal outputted from the temperature detecting means and a first reference voltage corresponding to the first set temperature to generate a control signal for turning on or off the heating means, and the controlling means compares the voltage of the detected temperature signal and a second reference voltage corresponding to the second set temperature to generate a control signal for turning on or off the charging of the charging and discharging means.

11. An image forming apparatus according to claim 7, wherein the specific load of the charging and discharging means is a load including an auxiliary heating means further included in the fixing means.

12. An image forming apparatus according to claim 7, wherein the charging and discharging means is charging and discharging means including an electric double layer capacitor.

13. A control method of an image forming apparatus that includes:

a fixing device including a heater to which electric power is fed from a commercial power supply and a temperature sensor that detects temperature of the heater; and an auxiliary power supply that is charged by the commercial power supply and discharges electricity to a specific load, the control method of an image forming apparatus comprising:

turning on the heater when a detected temperature of the temperature sensor descends and it becomes lower than a first set temperature, turning off the heater when the detected temperature rises and it becomes higher than the first set temperature, turning on the charging of the auxiliary power supply when the detected temperature rises and it becomes higher than a second set temperature, the second set temperature being higher than the first set temperature, and turning off the charging of the auxiliary power supply when the detected temperature descends and it becomes lower than the second set temperature.

14. A control method of an image forming apparatus according to claim 13, wherein the heater is turned on only when heating of the fixing device is permitted.

15. A control method of an image forming apparatus according to claim 13, wherein the charging of the auxiliary power supply is turned on only when the charging of the auxiliary power supply is permitted.

16. A control method of an image forming apparatus according to claim 13, wherein a voltage of the detected temperature signal outputted from the temperature sensor and a first reference voltage corresponding to the first set temperature are compared to generate a control signal for turning on or off the heater, and the voltage of the detected temperature signal and a second reference voltage corresponding to the second set temperature are compared to generate a control signal for turning on or off the charging of the auxiliary power supply.

17. A control method of an image forming apparatus according to claim 13, wherein the specific load of the auxiliary power supply is a load including an auxiliary heater further included in the fixing device.

18. A control method of an image forming apparatus according to claim 13, wherein the auxiliary power supply is an auxiliary power supply including an electric double layer capacitor.

* * * * *